US010464775B2

(12) United States Patent
Teugels

(10) Patent No.: US 10,464,775 B2
(45) Date of Patent: Nov. 5, 2019

(54) DEVICE FOR MANIPULATING PAPER STRIPS AND MACHINE FOR PRODUCING BOOKLETS OF PAPER SHEETS

(71) Applicant: Imperial Tobacco Limited, Bristol (GB)

(72) Inventor: Pascal Teugels, Wilrijk (BE)

(73) Assignee: IMPERIAL TOBACCO LIMITED, Bristol (GB)

( * ) Notice: Subject to any disclaimer, the term of this patent is extended or adjusted under 35 U.S.C. 154(b) by 523 days.

(21) Appl. No.: 14/900,234

(22) PCT Filed: Jun. 27, 2014

(86) PCT No.: PCT/EP2014/063633
§ 371 (c)(1),
(2) Date: Dec. 21, 2015

(87) PCT Pub. No.: WO2015/000798
PCT Pub. Date: Jan. 8, 2015

(65) Prior Publication Data

US 2016/0152435 A1 Jun. 2, 2016

(30) Foreign Application Priority Data

Jul. 3, 2013 (EP) ..... 13174891

(51) Int. Cl.
*B65H 45/28* (2006.01)
*B65H 45/24* (2006.01)

(52) U.S. Cl.
CPC ..... *B65H 45/28* (2013.01); *B65H 45/24* (2013.01)

(58) Field of Classification Search
CPC ..... B65H 45/24; B65H 45/28
(Continued)

(56) References Cited

U.S. PATENT DOCUMENTS 843,219 A * 2/1907 Lazar ..... B65H 45/24 270/40
1,046,325 A * 12/1912 Normand ..... B65H 45/24 270/40

(Continued)

FOREIGN PATENT DOCUMENTS

| | | |
|---|---|---|
| EP | 0272048 B1 | 7/1991 |
| GB | 688144 | 2/1953 |
| GB | 733500 | 7/1955 |

OTHER PUBLICATIONS

International Search Report mailed in corresponding International Application No. PCT/EP2014/063633 dated Sep. 26, 2014.

*Primary Examiner* — Michelle Lopez
*Assistant Examiner* — Chinyere J Rushing-Tucker
(74) *Attorney, Agent, or Firm* — Fox Rothschid LLP

(57) ABSTRACT

The invention relates to a device and method for manipulating a first paper strip (12) and at least one second paper strip (16) and a machine for producing booklets of paper sheets. The device comprises a conveying unit (64) providing a first conveying direction (14) for the first paper strip (12) and at least one second conveying direction (18) for the at least one second paper strip (14), wherein the at least one second conveying direction (18) is directed non-parallel to the first conveying direction (14), a meeting unit (58) at which the first paper strip (12) and the at least one second paper strip (16) meet to form a single strand of paper.

19 Claims, 9 Drawing Sheets

Figure 1:
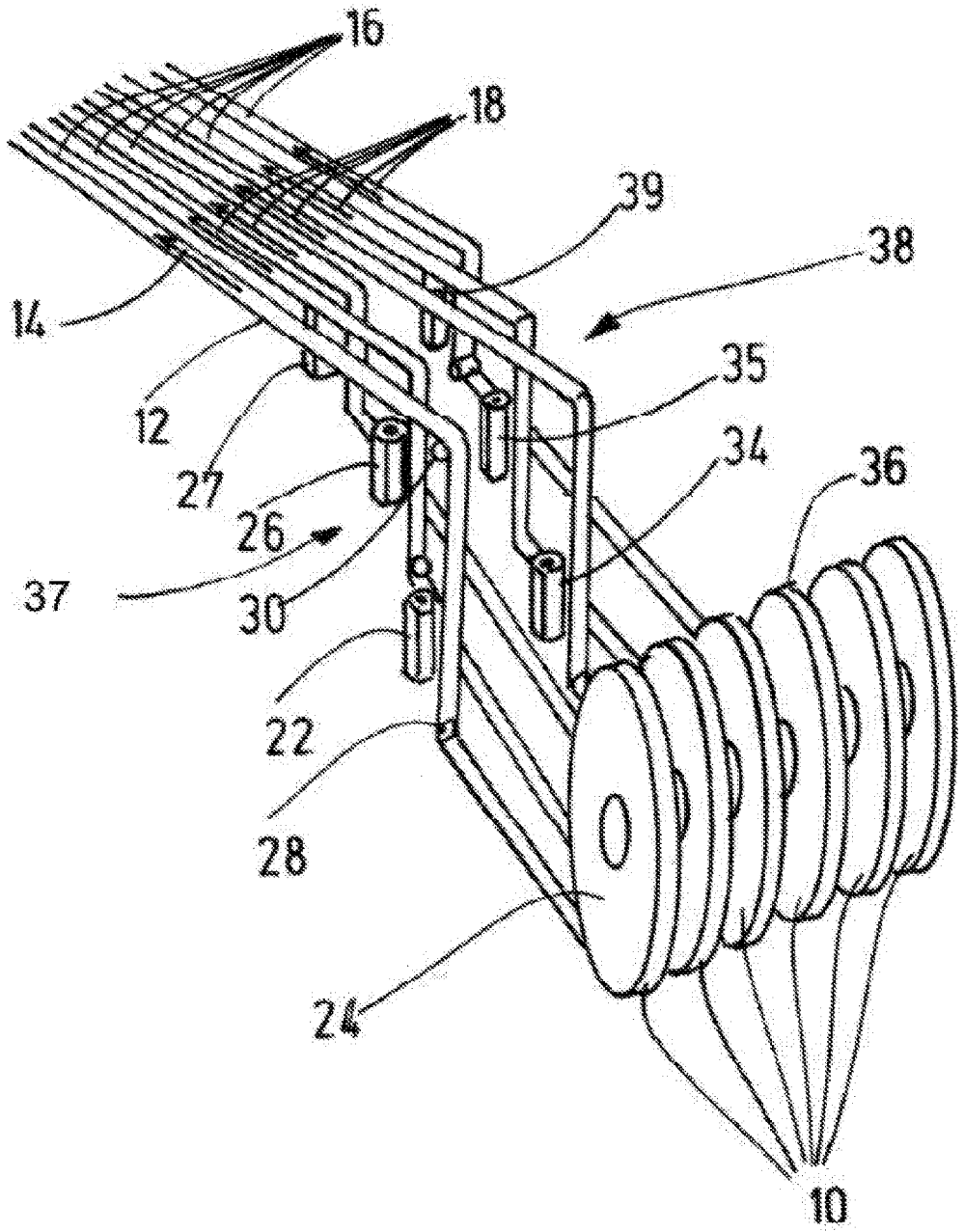

(58) Field of Classification Search
USPC ..... 493/342, 344, 353, 357, 361, 363, 365, 493/373; 83/931, 917, 934; 270/5.02, 270/5.03, 21.1
See application file for complete search history.

(56) References Cited

U.S. PATENT DOCUMENTS

| | | | | | |
|---|---|---|---|---|---|
| 4,290,592 | A * | 9/1981 | Kastner | B65H 35/06 | 270/40 |
| 4,648,862 | A * | 3/1987 | Jones | B65H 45/24 | 493/346 |
| 4,775,358 | A * | 10/1988 | Jones | B65H 45/24 | 270/40 |
| 5,891,007 | A * | 4/1999 | Bay | B26F 1/12 | 493/358 |
| 6,336,307 | B1 * | 1/2002 | O'Connor | B65D 85/67 | 270/39.05 |
| 8,353,505 | B2 * | 1/2013 | Kaneko | B41J 11/70 | 270/52.09 |
| 2005/0049129 | A1 * | 3/2005 | Belcastro | A24C 5/007 | 493/63 |
| 2010/0132571 | A1 * | 6/2010 | Hiesinger | B41F 13/58 | 101/219 |
| 2011/0025039 | A1 * | 2/2011 | Welker | B65H 45/28 | 283/62 |
| 2012/0202671 | A1 * | 8/2012 | Haupt-Terlau | B65H 35/02 | 493/419 |
| 2015/0336766 | A1 * | 11/2015 | Lupi | B65H 31/3054 | 493/379 |
| 2016/0023370 | A1 * | 1/2016 | Muller | B26D 7/325 | 83/88 |

* cited by examiner

DEVICE FOR MANIPULATING PAPER STRIPS AND MACHINE FOR PRODUCING BOOKLETS OF PAPER SHEETS

CROSS-REFERENCE TO RELATED APPLICATIONS

This application is a § 371 U.S. National Stage of International Application No. PCT/EP2014/063633, filed Jun. 27, 2014, which claims the priority to and the benefit of European Application No.: 13174891.5, filed Jul. 3, 2013, the entireties of which are both hereby incorporated herein by reference.

The invention relates to a device and method for manipulating a first paper strip and at least one second paper strip. The device comprises a conveying unit providing a first conveying direction for the first paper strip and at least one second conveying direction for the at least one second paper strip, wherein the at least one second conveying direction is directed non-parallel to the first conveying direction, and a meeting unit at which the first paper strip and the at least one second paper strip meet to form a single strand of paper. The method comprises the steps of conveying the first paper strip in a first conveying direction and conveying the at least one second paper strip in at least one second conveying direction, wherein the at least one second conveying direction is directed non-parallel to the first conveying direction, and directing the first paper strip and the at least one second paper strip to a meeting unit at which the first paper strip and the at least one second paper strip meet to form a single strand of paper. The invention further relates to a machine for producing booklets of paper sheets.

Devices for forming a stack of paper sheets are generally known in the prior art. In DE 42 01 256 A1 a machine for producing booklets of paper sheets is described, wherein a plurality of paper strips is conveyed in a single conveying direction. When running in the single conveying direction, further paper strips are added to the plurality of paper strips. The further paper strips are provided from paper strip sources arranged along the conveying direction and each paper strip source is arranged above the plurality of paper strips. EP 0 272 048 B1 describes a so called multi-bobbin machine for forming booklets of paper having forming means for converging paper strips from several sources into a single strand and means for advancing the strand in a first direction. Each paper strip is running in a different conveying direction and is directed towards a meeting point at which the paper strips meet to form a single strand of paper.

It is an object of the present invention to provide an enhanced device and method for manipulating a first paper strip and at least one second paper strip as well as an enhanced machine for producing booklets of paper sheets.

This object is achieved by a device according to independent claim 1.

It has been discovered by the invention that devices for manipulating paper strips and machines for producing booklets of paper sheets are either complex and prone to disorder and wearing down or, on the other hand, do not provide for manipulating the paper strips.

Especially, in machines for producing booklets of paper sheets, in which the paper strips are conveyed in a single conveying direction, the conveying distance (i.e. the distance the paper is travelling) is comparatively large. Since in these machines the conveying distance corresponds to the length of the machine, also the dimension of the machines is comparatively large. This makes a manipulation of a paper strip, which is to be formed at a certain position along the longitudinal extension of the paper strip, highly prone to wearing down of the machine. In particular, when chains are used for such machines to drive a conveying unit for the paper strips, during operation of such a machine the chains, due to wearing down, are stretched along their longitudinal extension. This will lead to misplacements of manipulations in the paper strips and, therefore, flaws in the booklet to be produced will occur. A further problem with such machines, in which the paper strips are conveyed in a single conveying direction, is that a flaw or defect of a manipulation can only be eliminated by exchanging all paper strips along the whole conveying unit, in which the paper strips show a single conveying direction. Such a task is highly complex, time consuming and leads to wasting of great amounts of production material, in particular paper strips. In contrast, the solution according to the present invention provides for an economic use of paper.

It has further been discovered by the invention that machines for forming booklets of paper, in which each paper strip is advanced in an individual conveying direction, do not provide for manipulation of a single paper strip. The reason for this was the design of such machines, which prohibited arrangement of any manipulation means due lack of space between the single components of the machine.

The solution according to the present invention provides for such a manipulation by a first cutting element adapted to form at least one recess in the first paper strip and/or at least one second cutting element adapted to form at least one recess in the at least one respective second paper strip. The manipulation of at least one or all of the single paper strips is advantageous for the further production process. A manipulation can serve as an indication for the further production process, such as a mark, but may also serve as a design element of the paper strip forming an essential feature of a further production process.

According to the present invention, the first cutting element is arranged along the first conveying direction spaced from the at least one second cutting element. The arrangement according to this embodiment leads to a better accessibility of each cutting element, e.g. from a lateral side of each paper strip. Thereby, also the exchange of cutting elements is simplified. Furthermore, space is saved, since the cutting elements may be arranged overlapping as seen in the respective conveying direction.

The first and the at least one second paper strip can be an integral paper strip (i.e. one-part) having a longitudinal extension. The respective paper strip is preferably forming one part which begins at a paper strip source and ends in an end portion of the device. Further preferably, the respective paper strip comprises or consists of a material adapted to be used for the production of cigarette papers. Therefore, the paper strip may comprise an adhesive section at a first lateral edge. The adhesive section may be stripe-shaped and consists of a material being used for adhesives in the field of cigarette paper production. The adhesive section extends on the first lateral edge along the longitudinal extension of the paper strip, preferably completely along the longitudinal extension of the respective paper strip. In the sense of the present invention the at least one second paper strip can be understood as one single paper strip or, preferably, as a plurality of second paper strips. Also the at least one second cutting element can be understood as one single second cutting element dedicated to the one single second paper strip and adapted to form at least one recess in the one single second paper strip. Furthermore, the at least one second cutting element can be understood as a plurality of second cutting elements, wherein each second cutting element is dedicated to one of the plurality of second paper strips and adapted to form at least one recess in one of the plurality of second paper strips.

The term "conveying unit" can be understood as an arrangement of guiding elements being arranged in a way to lead the first paper strip in a first conveying direction and the at least one second paper strip in at least one second conveying direction. This is done in a way that the at least one second conveying direction is directed non-parallel to the first conveying direction. Preferably, the at least one second conveying direction includes an acute angle with the adjacent first or second conveying direction. In case the at least one second paper strip consists of a plurality of second paper strips, each one of the plurality of second paper strips has a respective second conveying direction. Each second conveying direction is directed non-parallel to the first conveying direction and, preferably, each one of the second conveying directions is directed non-parallel to a respective other second conveying direction. Further preferably, the first paper strip and the plurality of second paper strips form a plurality of paper strips having a fan-shape as seen in a direction across the respective plurality of conveying directions, preferably as seen from above the device. In such a fan-shaped arrangement the plurality of first and second conveying directions lead to one meeting point. At this meeting point a meeting unit is arranged at which the first paper strip and the at least one second paper strip meet to form a single strand of paper. The single strand of paper can comprise one paper strip or a plurality of paper strips which can in certain embodiments be interleaved with one another. The interleaving of the paper strips can preferably be understood such that each paper strip is interleaved with an adjacent paper strip in the single strand of paper.

The first and the at least one second cutting element is adapted to form at least one recess in the at least one respective paper strip. In the sense of the present invention, this can be understood as each cutting element being adapted to form one or a plurality of recesses in the respective paper strip. This means that each cutting element is dedicated to one respective paper strip and adapted to form a plurality of recesses in this paper strip, preferably by working of a portion of the paper strip. Further preferably, each recess is spaced from a further adjacent recess in conveying direction (i.e. in longitudinal extension of the paper strip) by a constant distance. According to a first preferred embodiment, the device according to the present invention comprises an advancing unit adapted to pull the first and the at least one second paper strip from a respective paper strip source, in particular from a first paper strip source adapted to provide the first paper strip and from at least one second paper strip source adapted to provide the at least one second paper strip. The term "advancing unit" can be understood as two rotationally driven pulleys clamping the single strand of paper and, thereby, pulling the first and the at least one second paper strip in the respective conveying direction. The at least one second paper strip source can be understood as a plurality of paper strip sources, wherein each paper strip source is adapted to provide one of the plurality of second paper strips. In a fan-shaped arrangement of the first and the plurality of second paper strips, the first paper strip source and the plurality of second paper strip sources are preferably arranged on a segment of a circle, as seen from a direction across the conveying directions.

In a preferred enhancement of the preceding first preferred embodiment, the first and the at least one second cutting element is arranged along the respective first and the at least one second conveying direction between the respective paper strip source and the meeting unit. To allow such an arrangement of the cutting element, the device according to the present invention is designed having a distance from the paper strip source to the meeting unit being larger than the respective distance as it is known from multi-bobbin machines forming part of the prior art. This provides for an enhanced and simplified arrangement of the cutting elements. The running direction of the respective paper strip is changed only twice: once by a first guide pulley which leads the paper strip provided from the paper strip source in a direction substantially perpendicular to the respective conveying direction of the paper strip. Thereby, the conveying distance is reduced significantly. This also enhances the precision of the overall production line, since changes in length of each paper strip—due to the pulling forces acting on the paper strips—are reduced. Following the first guide pulley along the running direction of the paper strip, the respective cutting element is arranged to form a recess in the paper strip. The second change of running direction takes place at a second guide pulley following the cutting element along the running direction. The second guide pulley redirects the paper strip to further run in conveying direction.

Preferably, each guide pulley comprises a suction device for holding the paper strip in place and preventing the paper strip from slipping off the guide pulley. The suction device can comprise an opening at a surface of the pulley abutting the paper strip. This opening acts as a suction opening of the suction device to hold the paper strip securely to the pulley.

Preferably, the respective cutting elements are arranged close to the respective paper strip source as seen along the respective conveying direction of the respective paper strip. This is of advantage, since the space for arranging such a cutting element decreases along the conveying direction, especially in case of a fan-shaped arrangement of the device.

According to a second preferred embodiment, the device according to the present invention comprises a converging unit adapted to lead the first paper strip and the at least one second paper strip into the, preferably interleaved, single strand of paper. The term "converging unit" can be understood as an arrangement of passive elements such as metal walls with openings adapted to lead the plurality of paper strips into the conveying direction to form a single strand of paper at the meeting unit. Such a metal wall extends preferably perpendicular to the plurality of conveying directions. I.e. the wall forms a segment of a circle as seen from above the device. Furthermore, the wall has openings such as slots adapted to lead the respective paper strip and form the cross-sectional shape of the respective paper strip.

The converging unit can preferably be adapted to lead the first paper strip and the at least one second paper strip into an interleaved single strand of paper. In the sense of the present invention, this can be understood in a way that each paper strip is folded by the converging unit substantially along the middle of the paper strip. Thereby, as seen in cross-section, a first leg and a second leg are formed extending from the middle of the paper strip. When interleaved, a first leg of the first paper strip extends into a region between a first and second leg of the respective second paper strip. According to a third preferred embodiment, the device is adapted to form a stack of paper sheets, comprising a cutting unit adapted to cut off a stack of papers from the strand of paper. Thereby, a device is provided for forming a stack of paper sheets from the single strand of paper, the strand of paper being provided by the device according to the present invention. The cutting unit is preferably arranged in an end-region of the single strand of paper. Preferably, the cutting-unit may be adjusted with regard to the position along the longitudinal extension of the strand of paper, at which the cut off is performed. Such a cutting unit can be formed by a respective cutting unit known from the art as described in EP 0 272 048 B1.

In a fourth preferred embodiment of the device according to the present invention, the first cutting element and the at least one second cutting element are adapted to form the respective recess being opened towards a lateral side of the paper strip. Preferably, such a recess has a semicircle shape. In other words, the recess describes a section of a circle, preferably a semicircle along the lateral side of the paper strip. Such a recess shape is preferably advantageous for the production of cigarette papers having recesses of quadrant shape at two edges. Therefore, the cutting element can be preferably formed by a punching and/or stamping element having semicircle or circle shape or by a laser.

According to a further embodiment of the invention, the first cutting element and the at least one second cutting element is a laser.

According to a fifth preferred embodiment of the device according to the present invention, the first and the at least one second cutting element are adapted to form the recess in a region of the paper strip in which the strand of paper is divided into stacks of paper sheets. This is also of great advantage in the field of cigarette paper production, in particular where a recess of semicircle shape is formed as described in the preceding fourth preferred embodiment. Here, it is preferred that the respective cutting element is adapted to form the recess exactly at the position, as seen along the longitudinal extension of the paper strip, at which the strand of paper is divided into stacks of paper sheets. In case of a semicircle shape of the recess, this exact positioning will lead to quadrant shaped edges of the produced cigarette paper having substantially the same shape at each produced cigarette paper.

In case the at least one second cutting element is formed by a plurality of cutting elements, different arrangements are possible. According to a sixth embodiment of the device a first group of cutting elements is arranged spaced from a second group of cutting elements. Further preferably, there is a plurality of groups of cutting elements and each group of cutting elements is arranged at a certain position along the respective conveying direction. I.e. each group of cutting elements is arranged spaced from the other groups of cutting elements. This can be understood as a staggered arrangement of the plurality of cutting elements as seen in a direction across the respective conveying direction. According to a preferred embodiment of the device, a first group of cutting elements comprises first and second cutting elements in a staggered arrangement with respect to the meeting unit and at least one second group of cutting elements comprises second cutting elements in a staggered arrangement with respect to the meeting unit. According to a further improved embodiment of the device, the arrangement of the cutting elements within the first and second groups of cutting elements repeats seen in a direction across the conveying directions, preferably seen in a direction along a circular path around the meeting unit. The latter two embodiments enhance accessibility of each cutting element and save space.

According to a seventh preferred embodiment, the device according to the present invention comprises a positioning element adapted to adjust the cutting depth of the first and/or the at least one second cutting element across the first and/or the at least one second conveying direction. Preferably, the positing element is formed by a pivotable arm having a pivoting point and an end on which the respective cutting element is arranged. The pivotable arm is arranged in a way to provide an adjustment of the cutting depth in a direction perpendicular to the respective conveying direction. This means, when the arm is swiveled around the pivoting point, the cutting element is moved in a direction substantially perpendicular to the respective conveying direction. In other words, if the cutting element is moved closer to the respective paper strip, the cutting depth increases. On the other hand, if the cutting element is moved away from the paper strip, the cutting depth decreases. The regulation of the cutting depth is preferably achieved by means of a positioning member being connected to the pivotable arm and mounted on a spindle to be positioned in a linear direction by rotating the spindle. Thereby, a user may exactly control the cutting depth of the respective cutting element by turning (rotating) the spindle. One of the advantages of the positioning element according to this embodiment is that a consistent paper cut depth is achieved over all paper strips to be cut.

According to a second enhancement of the device according to the first preferred embodiment, the first and/or the at least one second paper strip source comprises or consists of a supply bobbin. This makes the device suitable for the use with paper strip sources as known from the art and in particular suitable for the use with paper strips being integral along the whole production path. The term "supply bobbin" can be under-stood as a single paper strip being furled or coiled up on a roll. The provision of the paper strip can be achieved by mounting the roll in a rotatable way and pulling the paper strip from the supply bobbin while the roll is rotating.

According to a third enhancement, the device according to the first preferred embodiment comprises a plurality of paper strip sources, comprising or consisting of a plurality of first supply bobbins arranged spaced from a plurality of second supply bobbins, in particular spaced substantially above the plurality of second supply bobbins, forming a gap between the plurality of first and second supply bobbins. This embodiment is of great advantage for the production of strands of paper having a comparatively high number of paper strips to be stacked. Even further preferably, this embodiment is advantageous for the forming of an interleaved strand of paper. The interleaving may then take place in a way that a first paper strip is provided from the plurality of first supply bobbins, wherein a second paper strip to be arranged adjacent to the first paper strip in the stack of paper sheets is provided from the plurality of second supply bobbins. The gap between the plurality of first and second supply bobbins provides for accessibility of the conveying unit as well as the respective cutting elements by an operator of the device according to the present invention.

According to a preferred enhancement of a proceeding third enhancement, the device comprises an upper group of cutting elements and a lower group of cutting elements, the upper group being arranged above the lower group, the cutting elements of the upper group of cutting elements being adapted each to form at least one recess in a paper strip provided by a first supply bobbin and the cutting elements of the lower group of cutting elements being adapted each to form at least one recess in a paper strip provided by a second supply bobbin. This embodiment enhances accessibility of each cutting element and saves space.

According to a preferred enhancement of the preceding third enhancement, the plurality of first supply bobbins is mounted rotatable, in particular hanging, in a first support frame arranged substantially above the plurality of first supply bobbins, wherein the plurality of second supply bobbins is mounted rotatable, preferably supported by, a second support frame arranged substantially underneath the plurality of second supply bobbins. Thereby, a simplified and suitable embodiment for providing a gap between the plurality of first and second supply bobbins is achieved. Moreover, an ergonomic means for feeding the device with paper as well for guiding the paper is achieved.

According to an eighth preferred embodiment, the device according to the present invention comprises a control unit adapted to control the first and/or the least one second cutting element, in particular with regard to the position of the recess in longitudinal extension of the respective paper strip. The control unit may preferably be formed by a centralized control unit having a computer device connected to each of the cutting elements. The control unit may be adapted to control the cutting depths of the respective cutting element as well as the position along the paper strip at which the recess is formed. In particular, the control unit may be adapted to synchronize the conveying velocity of the paper strips with the cutting elements providing for a predetermined position of each recess with regard to the longitudinal extension of the respective paper strip. Therefore, the control unit may comprise sensors for sensing the position of previously formed recesses in the respective paper strips. Even more particular, the control unit may be adapted to control the cutting elements in a way that the position of a recess in a paper strip along the longitudinal extension of the strand of paper corresponds to the position of a recess of a further paper strip of the same strand of paper.

According to a further preferred ninth embodiment, the device according to the present invention comprises a suction unit dedicated to at least one of the cutting elements, in particular arranged close to the first and/or the at least one second cutting element, wherein the suction unit is adapted to evacuate a portion of the paper strip removed by means of the respective cutting element to form the recess. Thereby, the portions re-moved during the manipulation of the respective paper strip are disposed efficiently. The suction unit may comprise a suction channel arranged close to each cutting element. The suction channel extends substantially perpendicular to the respective conveying direction of the paper strip.

In a preferred enhancement of the second preferred embodiment, the converging unit comprises: a shaping element adapted to transform the first and/or the at least one second paper strip into a V- or U-shape in cross section, and an interleaving element adapted to interleave the first and the at least one second paper strip to form a single strand of paper. The shaping element is preferably formed by a metal wall having openings of V- or U-shape. The interleaving is achieved in a way that each leg of the V- or U-shaped paper strip extends into a space between the two legs of the adjacent V- or U-shaped strip. Therefore, the interleaving element comprises a metal wall having an opening of saw-tooth shape through which the shaped paper strips run to be interleaved.

The object mentioned above is also achieved by a machine for producing booklets of paper sheets according to a further aspect of the invention, wherein the machine comprises a device of the kind described above. With respect to the advantages, embodiments and details of embodiments of this further aspect of the invention, it is referred to the preceding description of the respective features of the device and its embodiments.

The object mentioned above is also achieved by a method of the kind mentioned above comprising the steps of independent claim 17. With respect to advantages, embodiments and details of embodiments of this further aspect of the invention, it is referred to the preceding description of the respective features of the device and its embodiments. The step of conveying is preferably achieved by means of a conveying unit of the kind mentioned above. The step of forming a recess is preferably achieved by means of a first and second cutting element of the kind mentioned above.

According to further embodiments, the method is applied using a device according to any of the claims 1-18.

Figure 2:
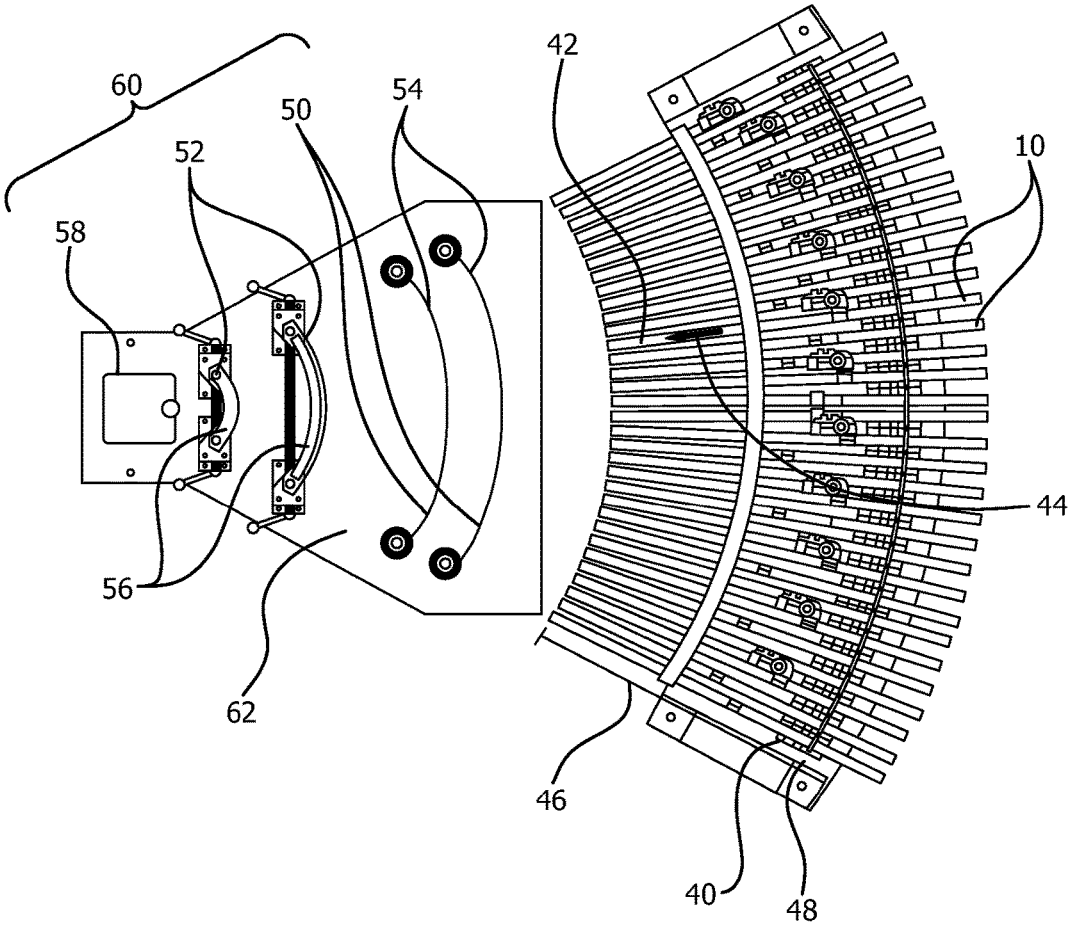
Figure 3:
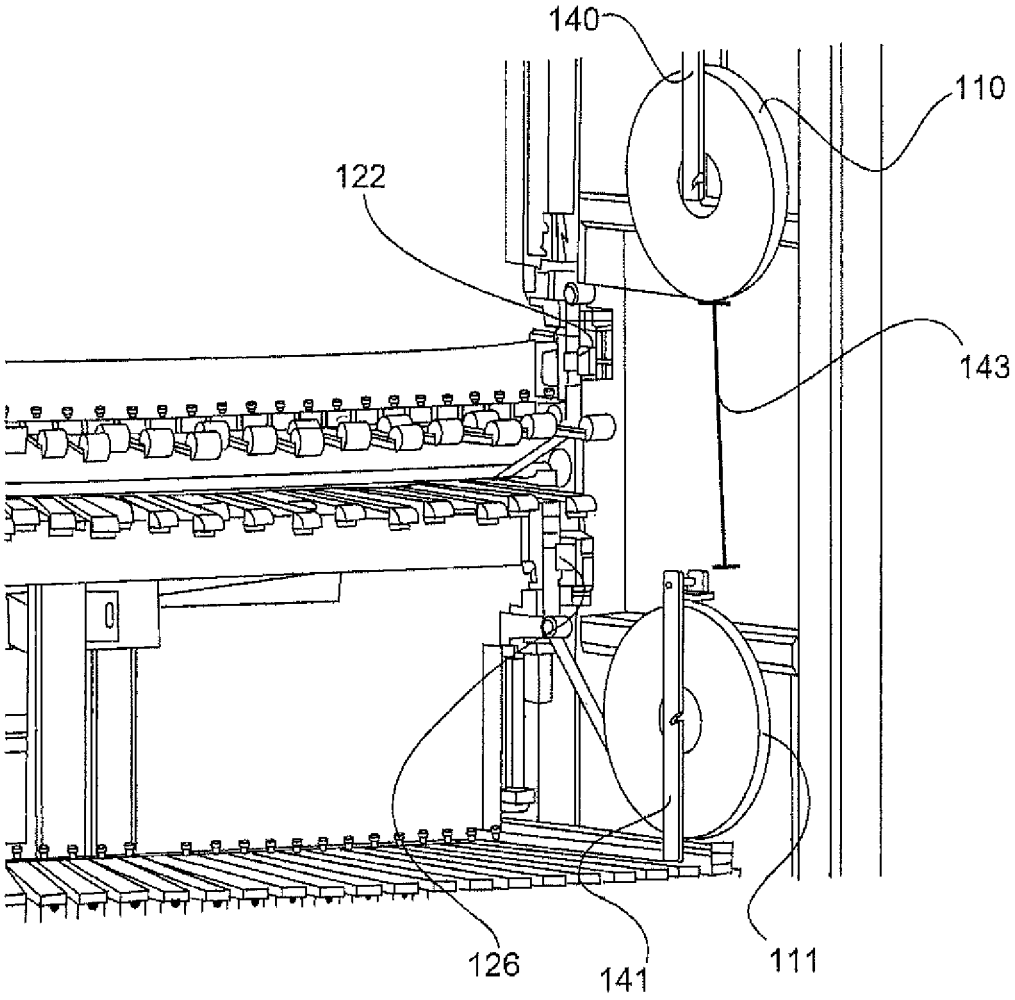
Figure 4:
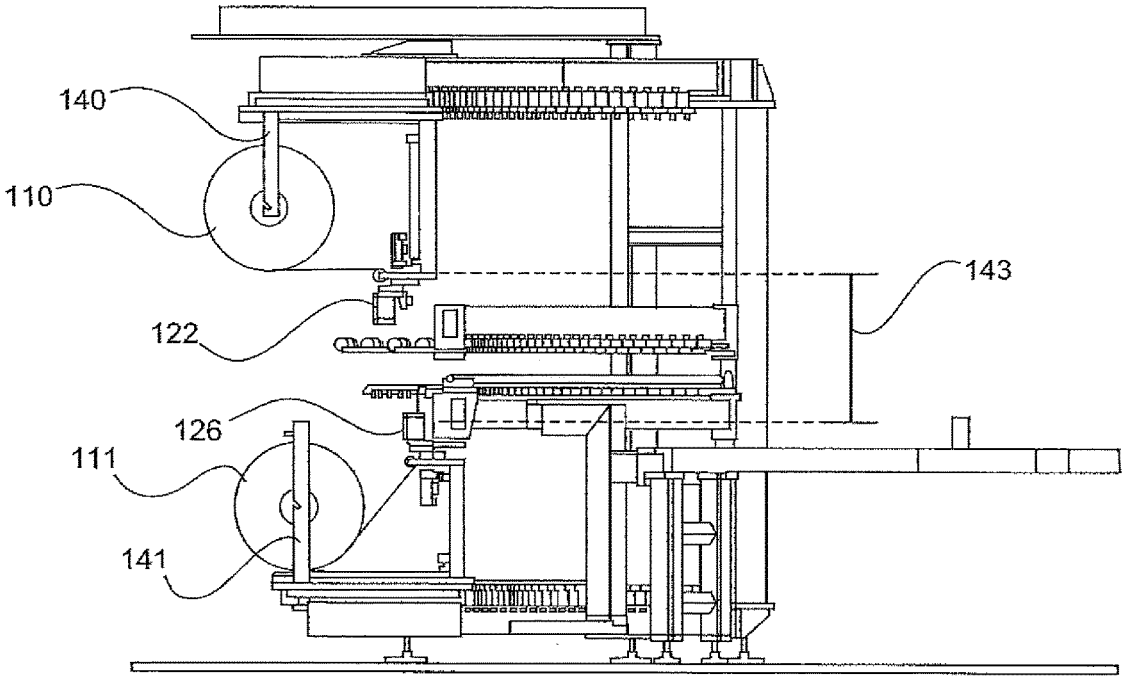
Figure 5:
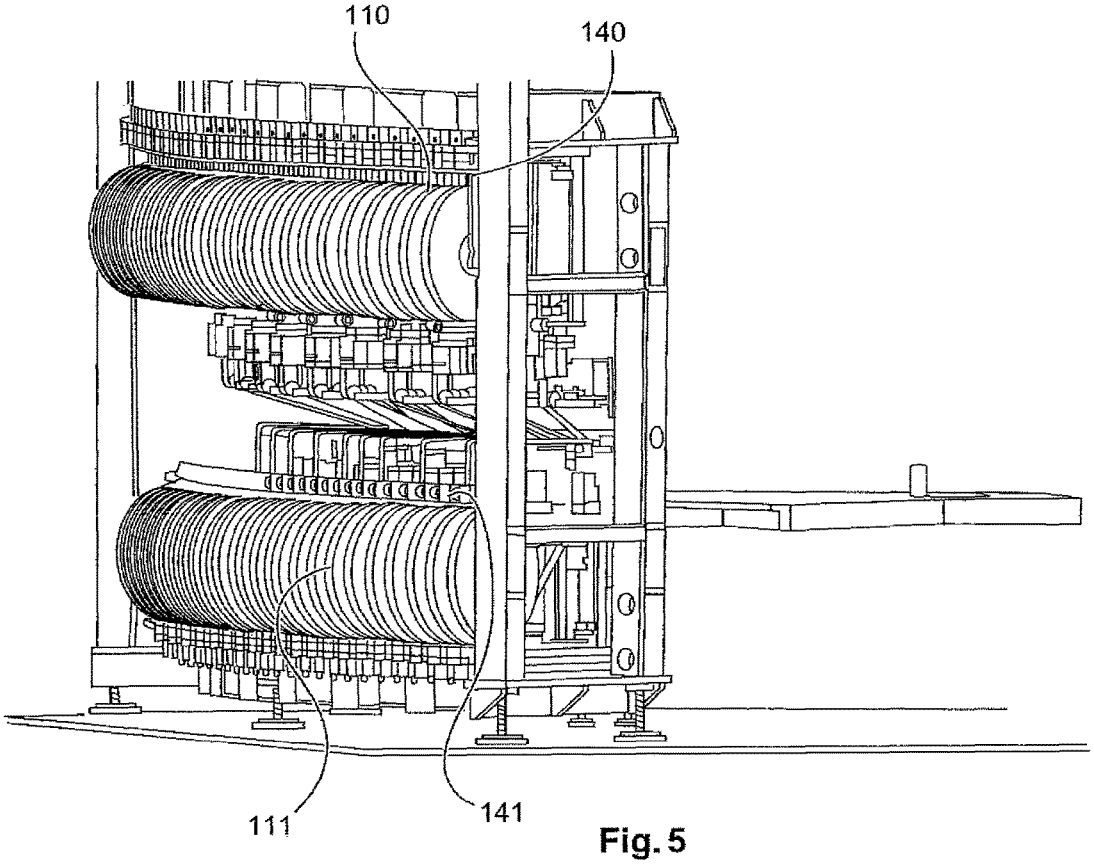
Figure 6:
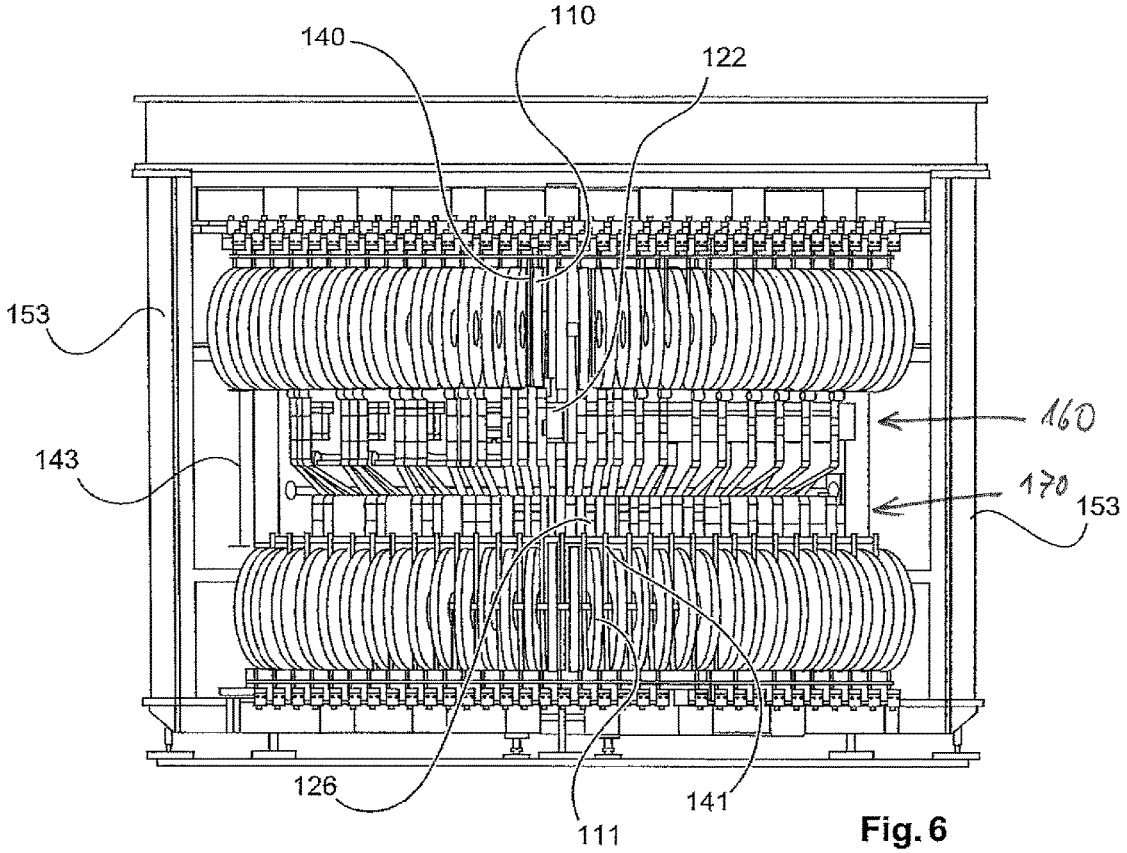
Figure 7:
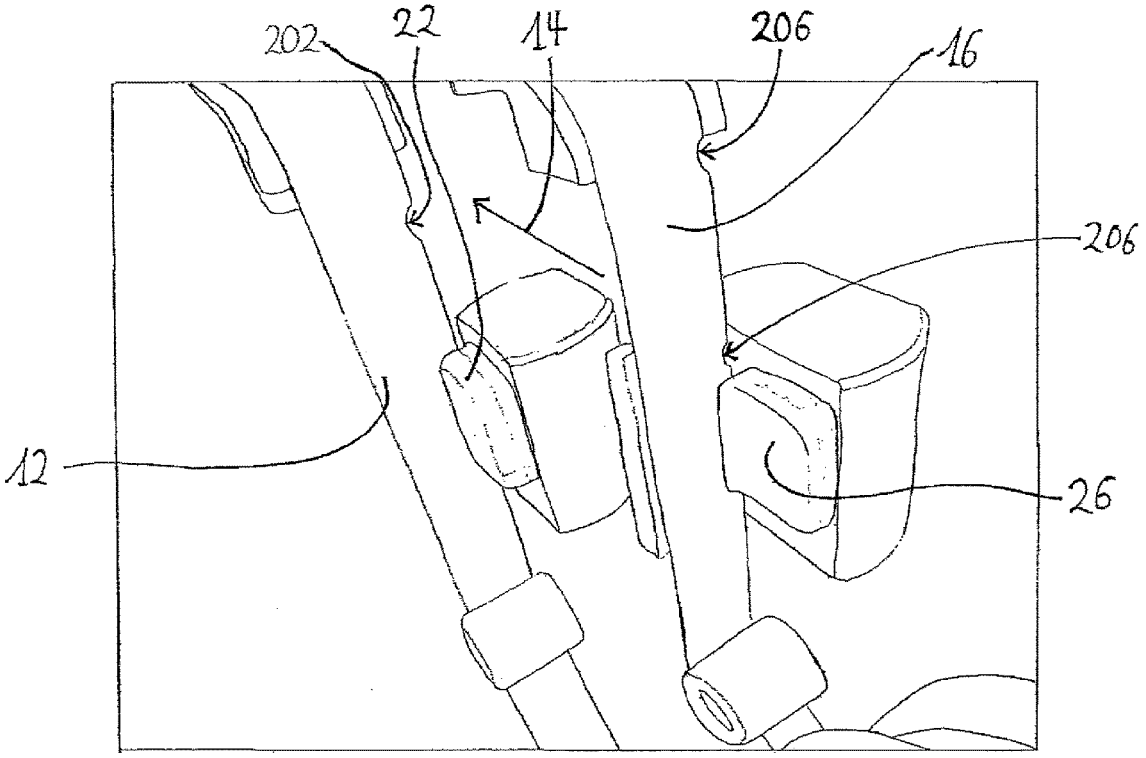
Figure 8:
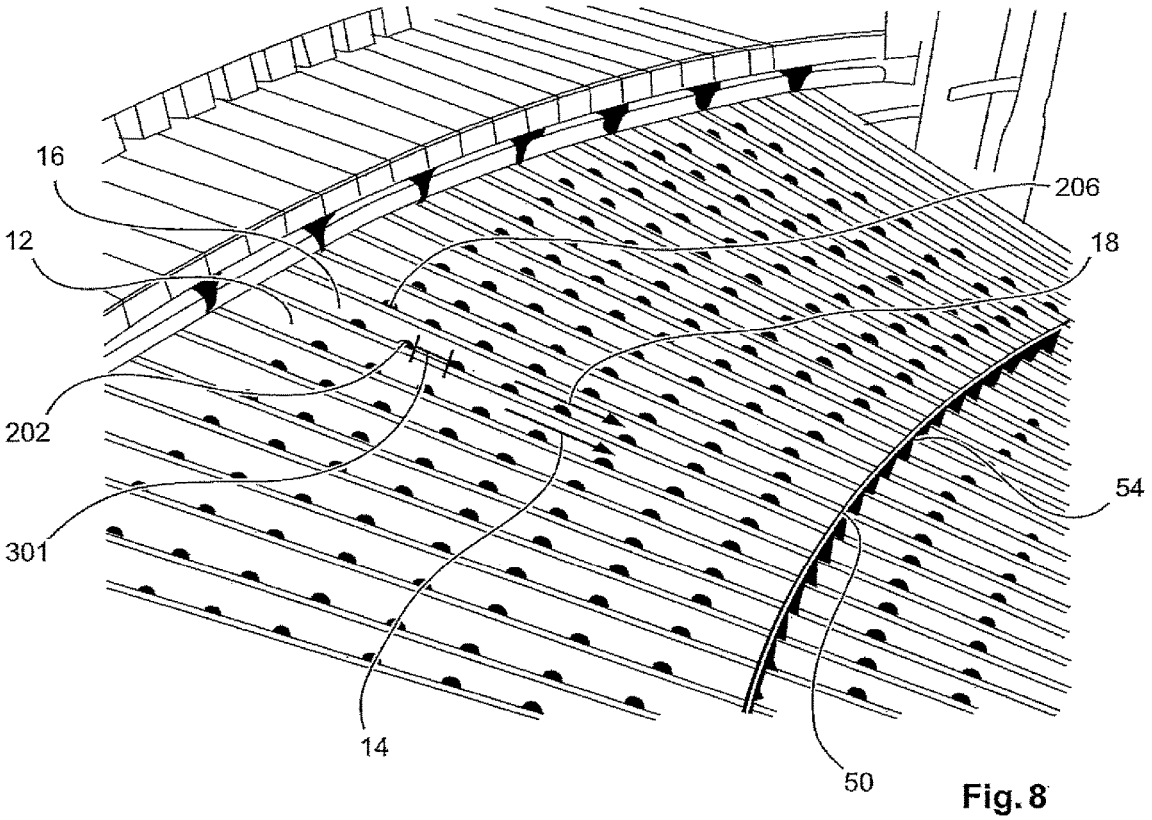
Figure 9:
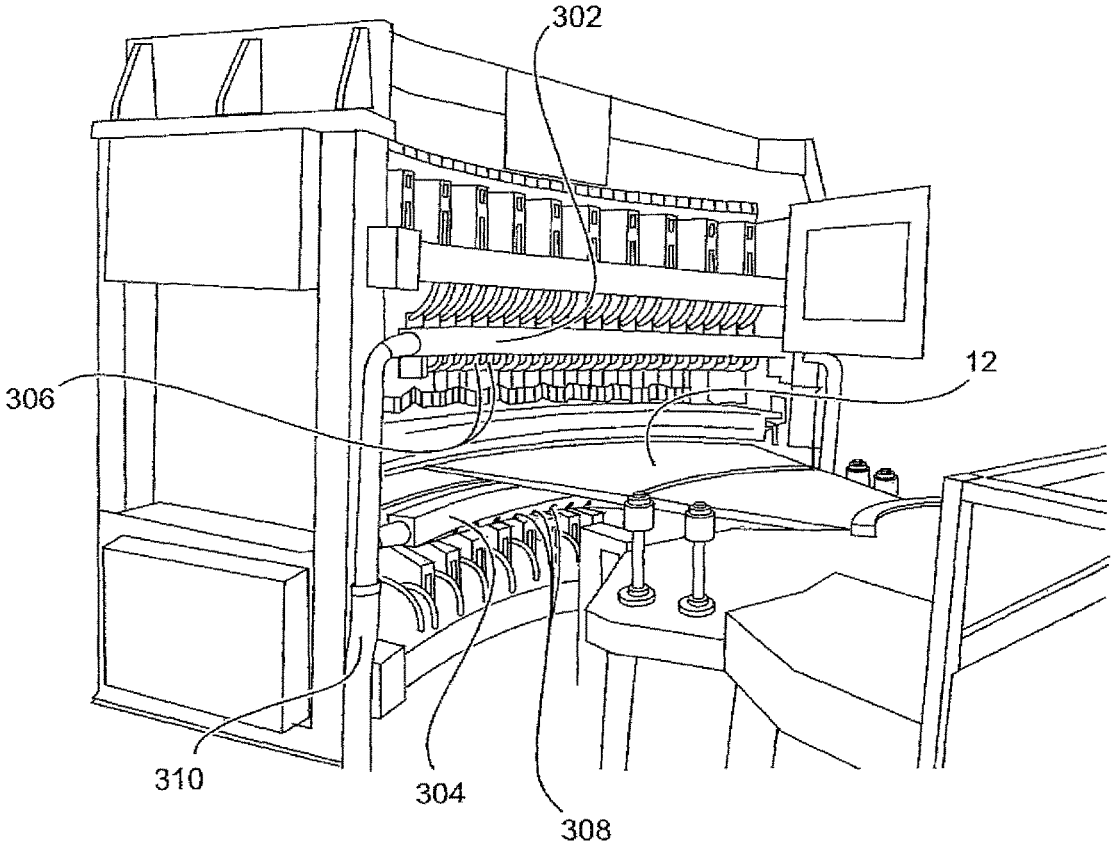

Preferred embodiments of the invention are described in connection with the figures, wherein FIG. 1 illustrates a first embodiment of a device according to the present invention in a perspective partial view, FIG. 2 illustrates the first embodiment shown in FIG. 1 in a plan view, FIG. 3 illustrates the first embodiment of the device according to the present invention in a second perspective partial view, FIG. 4 illustrates the device as shown in FIG. 3 in a side view, FIG. 5 illustrates the first embodiment of the device according to the present invention in a perspective third partial view, FIG. 6 illustrates the device shown in FIG. 5 in a backside view, FIG. 7 illustrates the first embodiment of the device according to the present invention in a further perspective partial view, FIG. 8 illustrates the first embodiment of the device according to the present invention in another perspective partial view, and FIG. 9 illustrates a second embodiment of the device according to the present invention in a perspective view.

FIGS. 1 to 8 show an embodiment of the device according to the present invention in different perspective and partial views. In FIG. 1, six supply bobbins 10 are shown providing each a single papers strip. A first paper strip 12 is running in a first conveying direction 14 and five second paper strips 16 are each running in five second conveying directions 18. The five second conveying directions 18 are each directed non-parallel to the first conveying direction 14. A first cutting element 22 is arranged in first conveying direction 14 spaced apart from a first paper strip source 24 formed by one of the supply bobbins 10. The first cutting element 22 is adapted to form a plurality of recesses in the first paper strip 12. The first cutting element 22 is arranged along the first conveying direction 14 spaced from at least one second cutting element 26. The first paper strip 12 is running from the first paper strip source 24 substantially in first conveying direction 14 and then redirected along a first guide pulley 28 in a direction substantially perpendicular to the first conveying direction. From thereon, the first paper strip 12 runs up to a second guide pulley 30 redirecting the first paper strip 12 to run again in first conveying direction 14. In a region between the first guide pulley 28 and second guide pulley 30, the first cutting element 22 is arranged and adapted to cut off portions of the first paper strip 12 to form a recess in the paper strip 12. The five second paper strips 16 show the same arrangement of first and second guide pulley having a second cutting element 26. The overall arrangement of the first and second elements is that the cutting elements are arranged at different positions along the respective conveying direction. Certain cutting elements show the same distance from the respective paper source as other cutting elements. For example first cutting element 22 is arranged in a certain distance in conveying direction 14 from the first paper strip source 24. Also, one of the second cutting elements, namely cutting element 34 is arranged in the same distance from its respective paper strip source 36.

According to FIG. 1, a first group of cutting elements 37 comprises a first cutting element 22 and second cutting elements 26, 27 in a staggered arrangement and a second group of cutting elements 38 comprises second cutting elements 34, 35 and 39 in a staggered arrangement. The arrangement of the cutting elements within the groups 37, 38 repeats seen in a direction across the conveying directions 14, 16. FIG. 2 shows a plan view of an embodiment of the device according to the present invention as shown in FIG. 1. In this plan view, thirty-two supply bobbins 10 are arrangement in a circle segment arrangement which is achieved by a support frame 40. Each supply bobbin 10 provides a paper strip 42 running in a respective conveying direction 44. In FIG. 2 the paper strips 42 are shown cut off at a certain distance 46 from the respective centre 48 of a respective supply bobbin 10. During operation, not shown in FIG. 2, each paper strip 42 runs towards and through a shaping element 50 and then further towards and through an interleaving element 52. The shaping element 50 is also shown in FIG. 8. This shaping element 50 is formed by two metal walls 54 extending substantially perpendicular to the respective conveying direction of a respective paper strip 42. The metal walls 54 have openings of V- or U-shape to transform the respective paper strip into a V- or U-shape in cross section. The interleaving element 52 is formed by two metal walls 56. Each of the two metal walls 56 extends in a circle segment curvature, substantially perpendicular to the respective conveying direction 44 of the respective paper strip 42. The paper strips 42 meet at a meeting unit 58, where they form a single strand of paper.

Cutting elements 22 and 26 are arranged along the respective conveying direction 44 between the supply bobbins 10 and the meeting point 58.

The shaping element 50, the interleaving element 52 and the meeting unit 58 form part of a converging unit 60 for leading the single paper strips into one single strand of paper. The converging unit 60 is supported by a table 62. The converging unit 60, the table 62 and the support frame 40 form part of a conveying unit 64 providing the overall arrangement including the plurality of conveying directions of the plurality of paper strips.

FIG. 3 shows a perspective partial view of the first embodiment of a device according to the present invention and FIG. 4 shows a side view of the device shown in FIG. 3. FIGS. 3 and 4 show the device in a state in which a first supply bobbin 110 is mounted rotatable in a first support frame 140 substantially arranged above the first supply bobbin and a second supply bobbin 111 is mounted rotatable in a second support frame 141 substantially arranged underneath the second supply bobbin 111. The arrangement of the first and second supply bobbin provides for a gap 143 between the first supply bobbin 110 and second supply bobbin 111. Thereby, a first cutting element 122 and a second cutting element 126 are accessible, for example accessible by an operator of the device.

FIG. 5 illustrates the device as shown in FIGS. 3 and 4 not only with one first supply bobbin 110 and one second supply bobbin 111, but shows a plurality of first supply bobbins 110 and second supply bobbins 111. FIG. 6 shows the device illustrated in FIG. 5 in a back side view. Each of the first supply bobbins 110 is hanging in a respective first support frame 140 and each of the second supply bobbins 111 is supported by a respective second support frame 141. The first support frames 140 and second support frames 141 are mounted in a common support frame 153. The gap 143 provided between the first supply bobbins 110 and the second supply bobbins 111 allows for access to the plurality of cutting elements 122 and 126.

The cutting elements 122 and 126 are arranged in an upper group of cutting elements 160 and in a lower group of cutting elements 170, the upper group of cutting elements being arranged above the lower group of cutting elements.

FIG. 7 shows a partial view of a first paper strip 12 and a second paper strip 16. In this partial view, the first paper strip 12 is redirected along a guide pulley 28 to run in a direction substantially perpendicular to a first conveying direction 14 of the first paper strip 12. A cutting element 22 is arranged to form a recess 202 of semicircle shape being open to a lateral side 204 of the first paper strip 12. A second cutting element 26 is arranged to form at least one recess 206 in the second paper strip 16. The first cutting element 22 is arranged along the first conveying direction 14 spaced from the second cutting element 26.

FIG. 8 shows a plurality of paper strips 12, 16 running in a respective conveying direction 14, 18 and being transformed by the shaping element 50. Each paper strip has a plurality of recesses 202, 206 of semicircle shape. The recesses 202, 206 are arranged along the respective paper strip 12, 16. Each respective recess 202, 206 is spaced from an adjacent recess by the same distance 301.

FIG. 9 shows a second embodiment of a device according to the present invention in a perspective view. The device shown in FIG. 9 has two suction units 302 and 304 formed by a plurality of suction channels 306 and 308 which lead to a common suction pipe 310. The common suction pipe 310 disposes portions of a respective paper strip 12 which have been worked off by the respective cutting element when forming the respective recess.

REFERENCE NUMBER LIST

10 supply bobbins
12 first paper strip
14 first conveying direction
16 second paper strip
18 second conveying direction
22, 122 first cutting element
24 first paper strip source
26, 27, 126 second cutting element
28 first guide pulley
30 second guide pulley
34 cutting element
35 cutting element
36 paper strip source
37 first group of cutting elements
38 second group of cutting elements
39 cutting element
40 support frame
42 paper strip
44 conveying direction
46 distance
48 centre
50 shaping element
52 interleaving element
54 metal walls
56 metal walls
58 meeting unit
60 converging unit
62 table
64 conveying unit
110 first supply bobbin

111 second supply bobbin
140 first support frame
141 second support frame
143 gap
153 common support frame
160 upper group of cutting elements
170 lower group of cutting elements
202 recess
204 lateral side
206 recess
302, 304 suction unit
306, 308 suction channel
310 common suction pipe

The invention claimed is:

1. A device for manipulating a first paper strip (12) and at least one second paper strip (16), comprising in conveying direction:

a conveying unit (64) providing a first conveying direction (14) for the first paper strip (12) and at least one second conveying direction (18) for the at least one second paper strip (14), wherein the at least one second conveying direction (18) is directed non-parallel to the first conveying direction (14), a meeting unit (58) at which the first paper strip (12) and the at least one second paper strip (16) meet to form a single strand of paper, and a cutting unit adapted to cut off a stack of papers from the strand of paper, wherein the device further comprises:

a first cutting element (22) adapted to form at least one recess (202) at a certain position along a longitudinal extension of the first paper strip (12), wherein the recess (202) being open towards a lateral side (204) of the first paper strip (12), and at least one second cutting element (26) adapted to form at least one recess (206) at a certain position along the longitudinal extension of the at least one respective second paper strip (16), wherein the recess (206) being open towards a lateral side (204) of the second paper strip (16), wherein the first cutting element (22) is arranged along the first conveying direction (14) spaced from the at least one second cutting element (26); and wherein: the first cutting element (22) and the at least one second cutting element (26) are positioned in conveying direction upstream of the meeting unit (58).

2. The device according to claim 1, comprising:

an advancing unit adapted to pull the first (12) and the at least one second paper strip (16) from a respective paper strip source (24; 36), wherein a first paper strip source (24) is adapted to provide the first paper strip (12) and the at least one second paper strip source (36) is adapted to provide the at least one second paper strip (16).

3. The device according to claim 2, wherein the first (22) and the at least one second cutting element (26) is arranged along the respective first (14) and the at least one second conveying direction (18) between the respective paper strip source (24; 36) and the meeting unit (58).

4. The device according to claim 1, comprising:

a converging unit (60) adapted to lead the first paper strip (12) and the at least one second paper strip (16) into the interleaved single strand of paper.

5. The device according to claim 1, wherein the recess (202; 206) has a semicircular shape.

6. The device according to claim 1, wherein the first (22) and the at least one second cutting element (26) are adapted to form the recess (202; 206) in a region of the first paper strip (12) and of the at least one second paper strip (16) in which the strand of paper is divided into stacks of paper sheets.

7. The device according to claim 1 wherein a first group of cutting elements (37) is arranged spaced from at least one second group of cutting elements (38).

8. The device according to claim 1, wherein a first group of cutting elements (37) comprises first and second cutting elements (22, 26, 27) in a staggered arrangement with respect to the meeting unit (58) and at least one second group of cutting elements (38) comprises second cutting elements (34, 35, 39) in a staggered arrangement with respect to the meeting unit (58).

9. The device according to claim 1, wherein the arrangement of cutting elements within the first and second groups of cutting elements (37, 38) repeats seen in a direction across the first conveying direction (14) and the at least one second conveying direction (18).

10. The device according to claim 1, comprising:

a positioning element adapted to adjust the cutting depth of the first and/or the at least one second cutting element (22, 26) across the first and/or the at least one second conveying direction.

11. The device according to claim 1, wherein the first and/or the at least one second paper strip source comprises or consists of a supply bobbin (10; 110; 111).

12. The device according to claim 1, comprising:

a plurality of paper strip sources, comprising or consisting of a plurality of first supply bobbins (110) arranged spaced from a plurality of second supply bobbins (111), in particular spaced substantially above the plurality of second supply bobbins, forming a gap (143) between the plurality of first and second supply bobbins (110; 111).

13. The device according to claim 12, wherein the plurality of first supply bobbins (110) is mounted rotatable, in particular hanging, in a first support frame (140) arranged substantially above the plurality of first supply bobbins (110), and wherein the plurality of second supply bobbins (111) is mounted rotatable in, preferably supported by, a second support frame (141) arranged substantially underneath the plurality of second supply bobbins (111).

14. The device according to claim 12, comprising an upper group of cutting elements (160) and a lower group of cutting elements (170), the upper group of cutting elements (160) being arranged above the lower group of cutting elements (170), the cutting elements of the upper group of cutting elements (160) being adapted each to form at least one recess in a paper strip provided by a first supply bobbin (110) and the cutting elements of the lower group of cutting elements (170) being adapted each to form at least one recess in a paper strip provided by a second supply bobbin (111).

15. The device according to claim 1, comprising:

a control unit adapted to control the first and/or the at least one second cutting element, in particular with regard to the position of the recess in longitudinal extension of the respective paper strip.

16. The device according to claim 1, comprising:

a suction unit (302; 304) dedicated to at least one of the cutting elements, in particular arranged close to the first and/or the at least one second cutting element, wherein the suction unit (302; 304) is adapted to evacuate a portion of the paper strip removed by means of the respective cutting element to form the recess (202; 206).

17. The device according to claim 1, wherein the converging unit comprises:

a shaping element (50) adapted to transform the first (12) and/or the at least one second paper strip (16) into a V- or U-shape in cross-section, and an interleaving element (52) adapted to interleave the first (12) and the at least one second paper strip (16) to form a single strand of paper.

18. A machine for producing booklets of paper sheets, the machine comprising a device according to claim 1.

19. A method for manipulating a first paper strip (12) and at least one second paper strip (16), comprising the steps of:

conveying the first paper strip (12) in a first conveying direction (14) and conveying the at least one second paper strip (16) in at least one second conveying direction (18), wherein the at least one second conveying direction (18) is directed non-parallel to the first conveying direction (14), directing the first paper strip (12) and the at least one second paper strip (16) to a meeting unit (58) at which the first paper strip (12) and the at least one second paper strip (16) meet to form a single strand of paper, cutting off a stack of papers from the strand of paper, forming at least one recess (202) in the first paper strip (12) and/or forming at least one recess (206) in the at least one respective second paper strip (16), the recess (202) being open towards a lateral side (204) of the first paper strip (12), and the recess (206) being open towards a lateral side (204) of the second paper strip (16).

* * * * *